US009755307B2

(12) United States Patent
Chi et al.

(10) Patent No.: US 9,755,307 B2
(45) Date of Patent: Sep. 5, 2017

(54) ANTENNA STRUCTURE AND WIRELESS COMMUNICATION DEVICE EMPLOYING SAME

(71) Applicant: FIH (Hong Kong) Limited, Kowloon (HK)

(72) Inventors: Chuan-chou Chi, New Taipei (TW); Hao-Ying Chang, New Taipei (TW)

(73) Assignee: FIH (HONG KONG) LIMITED, Kowloon (HK)

( * ) Notice: Subject to any disclaimer, the term of this patent is extended or adjusted under 35 U.S.C. 154(b) by 266 days.

(21) Appl. No.: 14/469,881

(22) Filed: Aug. 27, 2014

(65) Prior Publication Data

US 2015/0061943 A1 Mar. 5, 2015

(30) Foreign Application Priority Data

Aug. 29, 2013 (TW) ..... 102131141 A

(51) Int. Cl.

| | |
|---|---|
| ***H01Q 5/00*** | (2015.01) |
| ***H01Q 21/30*** | (2006.01) |
| ***H01Q 5/371*** | (2015.01) |
| ***H01Q 5/378*** | (2015.01) |

(52) U.S. Cl.

CPC ..... *H01Q 5/371* (2015.01); *H01Q 5/378* (2015.01); *H01Q 21/30* (2013.01)

(58) Field of Classification Search

CPC ..... H01Q 5/371; H01Q 5/378; H01Q 21/30

See application file for complete search history.

(56) References Cited

U.S. PATENT DOCUMENTS 8,872,707 B2 * 10/2014 Chen ..... H01Q 1/2266 343/700 MS 9,002,262 B1 * 4/2015 Kuo ..... H01Q 1/50 343/702

OTHER PUBLICATIONS

Antenna Theory: A Review, Balanis, Proc. IEEE vol. 80 No. 1 Jan. 1992.*

* cited by examiner

*Primary Examiner* — Robert Karacsony
*Assistant Examiner* — Amal Patel
(74) *Attorney, Agent, or Firm* — Steven Reiss

(57) ABSTRACT

An antenna structure includes a feeding portion, a first grounding portion, a second grounding portion, a first radiating portion, a second radiating portion, a third radiating portion, and a fourth radiating portion. The feeding portion is configured to feed current signals. The first and second grounding portions are positioned at two opposite sides of the feeding portion respectively. The first, second and third radiating portions cooperatively form a first current path to excite a low-frequency resonate mode and a first high-frequency resonate mode; the first radiating portion resonates with the first grounding portion to excite a second high-frequency resonate mode; the second, third and fourth radiating portion cooperatively form a second current path to excite a third high-frequency resonate mode.

6 Claims, 4 Drawing Sheets

ANTENNA STRUCTURE AND WIRELESS COMMUNICATION DEVICE EMPLOYING SAME

FIELD

The subject matter herein generally relates to antenna structures, and particular to an antenna structure having coplanar waveguide structure and a wireless communication device employing same.

BACKGROUND

With improvements in the integration of wireless communication systems, antennas have become increasingly important. For a wireless communication device to utilize various frequency bandwidths, antennas having wider bandwidth have become a significant technology.

BRIEF DESCRIPTION OF THE DRAWINGS

Implementations of the present technology will now be described, by way of example only, with reference to the attached figures.

DETAILED DESCRIPTION

Figure 1:
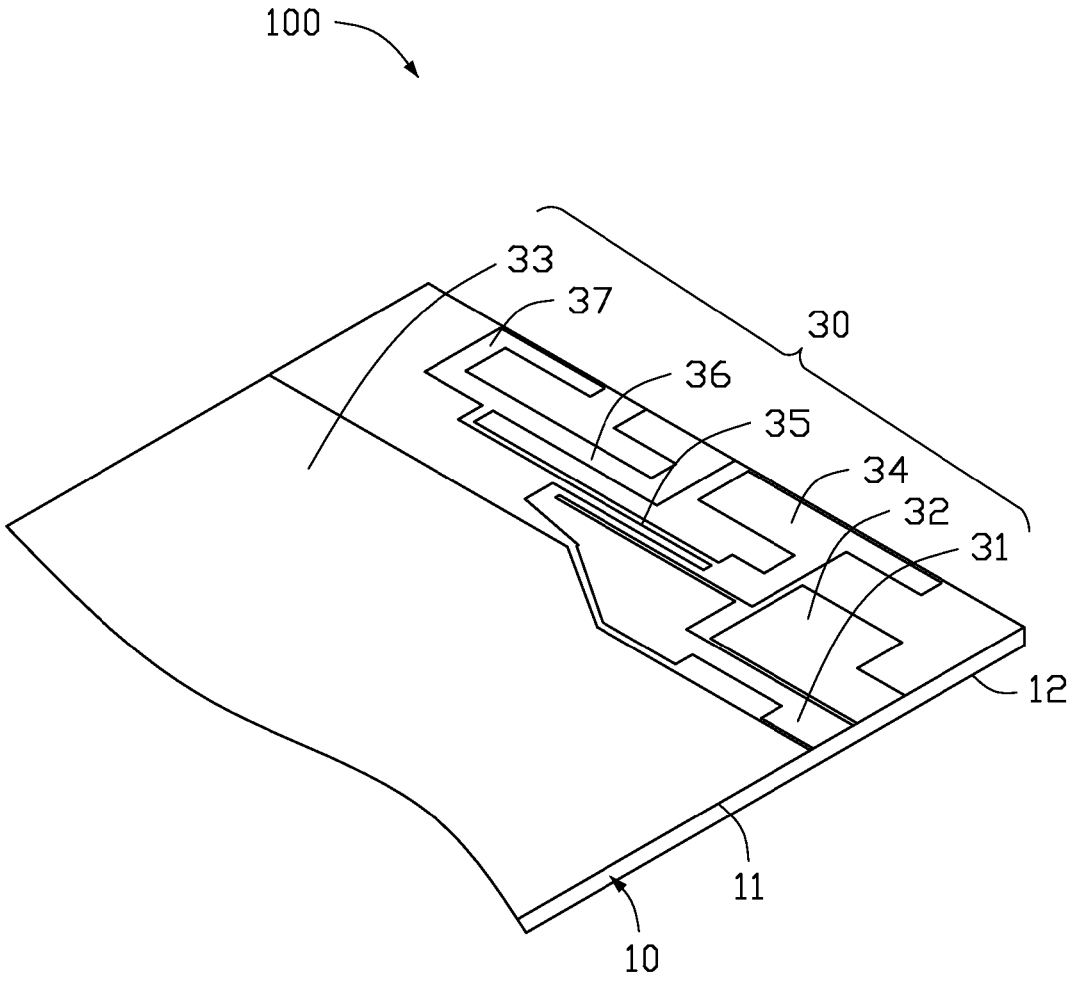
FIG. 1 is an isometric view of one embodiment of a wireless communication device employing an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" when utilized, means "including, but not necessarily limited to"; it specifically indicates open-ended inclusion or membership in the so-described combination, group, series and the like.

FIG. 1 illustrates an isometric view of one embodiment of a wireless communication device 100 employing a dielectric substrate 10 and an antenna structure 30. The antenna structure 30 is positioned on the dielectric substrate 10, and includes a feeding portion 31, a first grounding portion 32, a second grounding portion 33, a first radiating portion 34, a second radiating portion 35, a third radiating portion 36, and a fourth radiating portion 37. The feeding portion 31 is electronically coupled to a radio frequency circuit, and is configured to feed current signals. The first and second grounding portion 32 and 33 are positioned adjacent to two opposite sides of the feeding portion 31, and are spaced apart from the feeding portion 31, such that a coplanar waveguide ("CPW") feed structure is formed. The first radiating portion 34 is coupled to the feeding portion 31. The second radiation portion 35 is coupled to the first radiating portion 34. The third and fourth radiating portions 36 and 37 are coupled to the second radiating portion 35. The first, second and third radiating portions 34, 35 and 36 cooperatively form a first current path to excite a low-frequency resonate mode and a first high-frequency resonate mode, the first radiating portion 34 resonates with the first grounding portion 32 to excite a second high-frequency resonate mode; the second, third and fourth radiating portion 35, 36 and 37 cooperatively form a second current path to excite a third high-frequency resonate mode.

The dielectric substrate 10 includes a first surface 11 and an opposite second surface 12. The antenna structure 30 is positioned on the first surface 11. In one embodiment, the feeding portion 31, the first grounding portion 32, the first, second, third and fourth radiating portions 34, 35, 36 and 37 are positioned at one end of the first surface 11. The first, second, third and fourth radiating portions 34, 35, 36 and 37 are positioned at a side of the feeding portion 31 opposite the second grounding portion 33. The second grounding portion 33 is a metal film, which covers on the remaining of the first surface 11. The second surface 12 is configured to layout electronic components, such as processor, power supply unit (not shown), of the wireless communication device 100.

Figure 2:
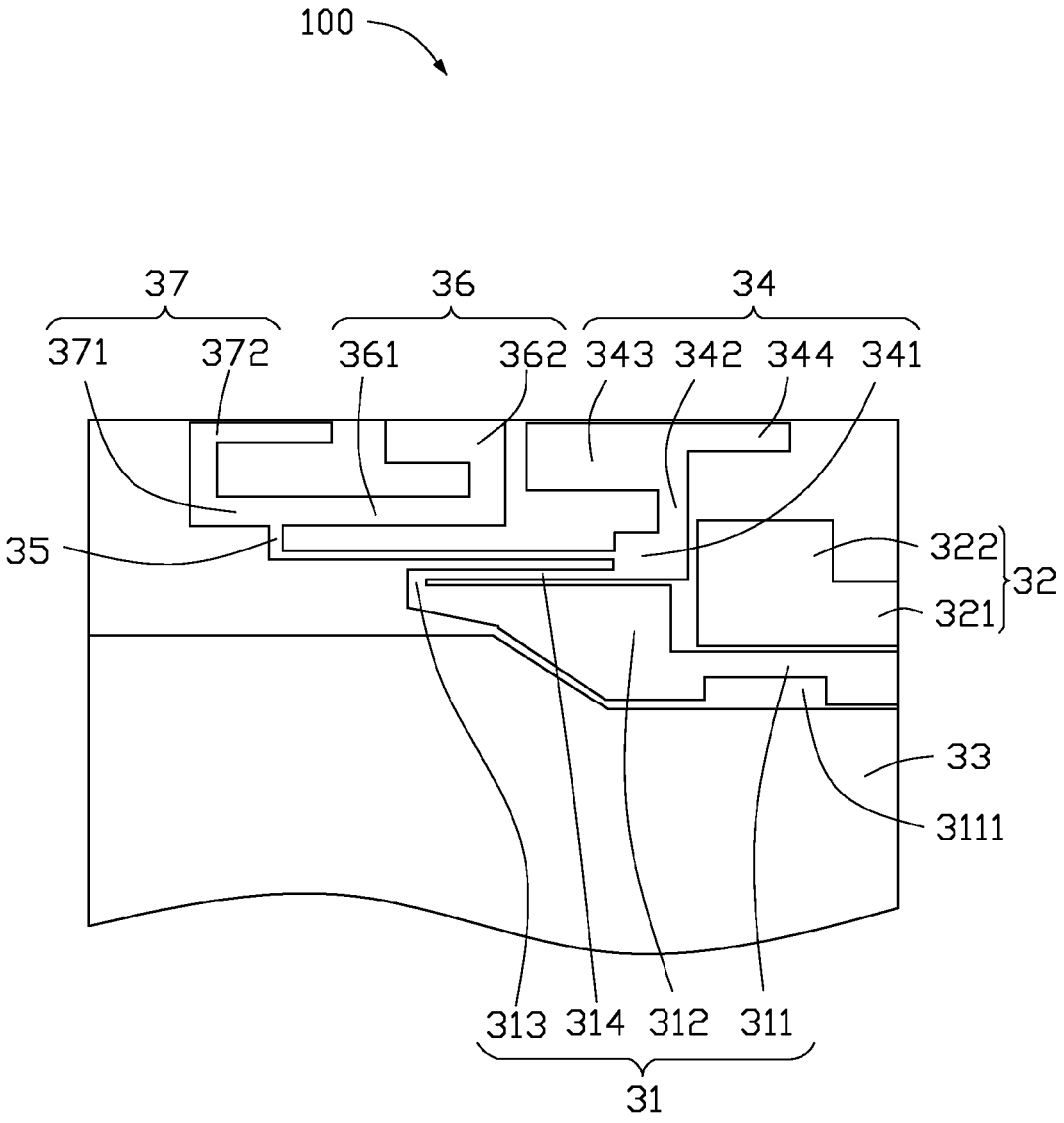
FIG. 2 is a top plan view of the wireless communication device shown in FIG. 1.

FIG. 2 illustrates a top plan view of the wireless communication device 100 shown in FIG. 1. The feeding portion 31 includes a first section 311, a second section 312, a third section 313, and a fourth section 314 all of which are coupled sequentially. The first section 311 defines a substantially rectangular cutout 3111 at one side thereof facing the second grounding portion 33. A first end of the second section 312 connecting to the first section 311 is wider than a second end of the second section 312 connecting to the third section 313. The third section 313 is substantially perpendicular to both the second section 312 and the fourth section 314. The fourth section 314 is substantially parallel to the second section 312.

The first grounding portion 32 is positioned adjacent to the first radiating portion 34, and includes a first strip 321 and a second strip 322. The first strip 321 is a substantially rectangular sheet, and is substantially parallel to the first section 311 of the grounding portion 31. The second strip 322 substantially perpendicularly extends from an end of the first strip 321 along a direction away from the first section 311 of the feeding portion 31.

The first radiating portion 34 includes a first arm 341, a second arm 342, a third arm 343, and a fourth arm 344. The first arm 341 is coupled to one end of the fourth section 314 of the feeding portion 31, and is wider than the fourth section 314. The second arm 342 substantially perpendicularly extends from the first arm 341. The third and fourth arms 343 and 344 substantially perpendicularly extend from two opposite sides of the second arm 342, respectively. The third arm 343 is wider than the fourth arm 344.

The second radiation portion 35 is substantially L-shaped. One end of the second radiation portion 35 is coupled to one end of the first arm 341 of the first radiating portion 34, and parallel to the fourth section 314 of the feeding portion 31, another end of the second radiation portion 35 is coupled to both the third radiating portion 36 and the fourth radiating portion 37.

The third radiating portion 36 and fourth radiating portion 37 extends toward two opposite directions from the second radiating portion 35, respectively. In particular, the third radiating portion 36 includes a fifth arm 361 and a sixth arm 362. The fifth arm 361 substantially perpendicularly extends from the second radiating portion 35 facing the second arm 342 of the first radiating portion 34. The sixth arm 362 is substantially L-shaped and adjacent to the third arm 343 of the first radiating portion 34, one end of the sixth arm 362 is substantially perpendicularly coupled to the fifth arm 361.

The fourth radiating portion 37 includes a seventh arm 371 and a eighth arm 372. The seventh arm 371 continuously extends from the fifth arm 361 of the third radiating portion 36. The eighth arm 372 is substantially L-shaped, and is substantially perpendicularly coupled to the seventh arm 371, and a distal end of the eight arm 372 faces a distal end of the sixth arm 362.

In use, when current signals are fed to the feeding portion 31, the first, second and third radiating portions 34, 35 and 36 cooperatively form a first current path to excite a low-frequency resonate mode to receive/send wireless signals at a low-frequency band from about 791 MHz to about 960 MHz, and a first high-frequency resonate mode to receive/send wireless signals at about 1900 MHz which is a harmonic of the low-frequency band; the first radiating portion 34 resonates with the first grounding portion 32 to excite a second high-frequency resonate mode to receive/send wireless signals at about 2170 MHz; the second, third and fourth radiating portion 35, 36 and 37 cooperatively form a second current path to excite a third high-frequency resonate mode to receive/send wireless signals from about 2500 MHz to about 2690 MHz. Thus, the antenna structure 30 can operate at frequency bands from about 791 MHz to about 960 MHz and from about 1710 MHz to about 2700 MHz. In addition, by changing the length of the first current path formed by the first, second and third radiating portions 34, 35 and 36, and a distance between the first radiating portion 34 and the third radiating portion 36, the low-frequency band can be expanded to from about 704 MHz to about 960 MHz, and a low frequency bandwidth of 256 MHz can be achieved.

Figure 3:
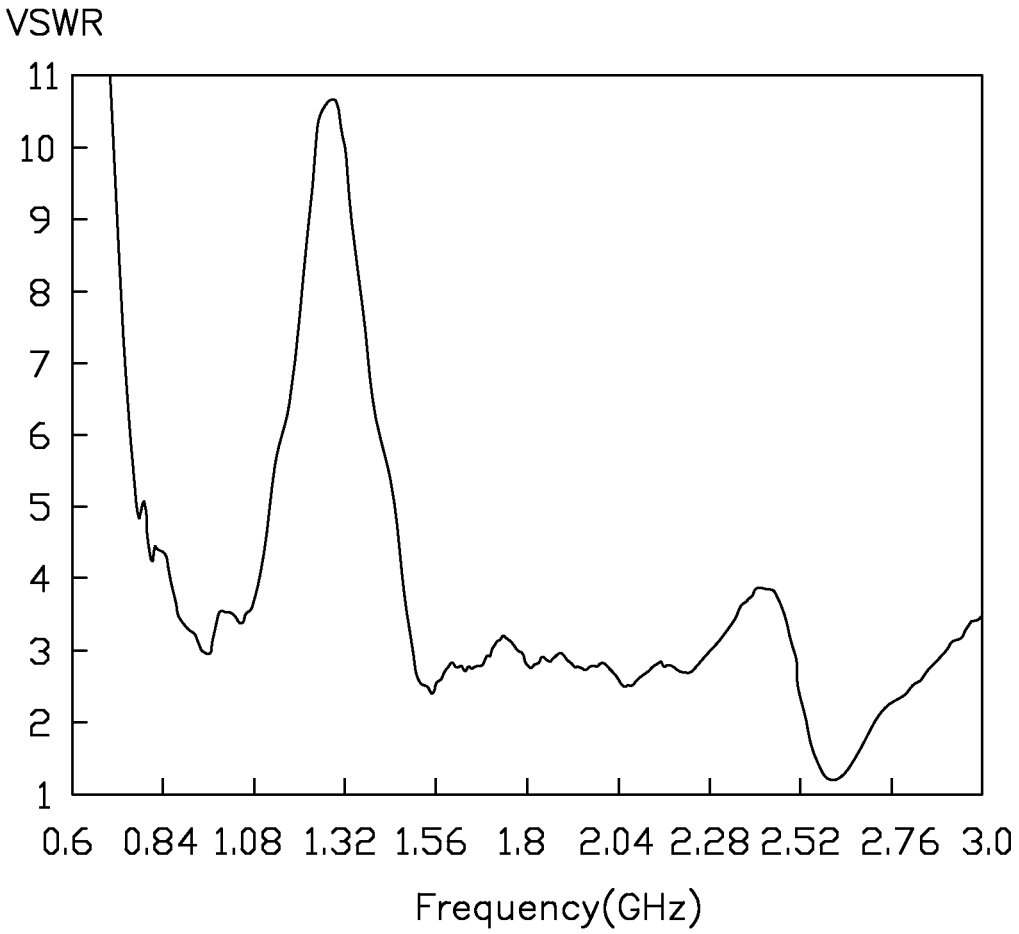
FIG. 3 is a voltage standing wave ratio ("VSWR") measurement of the antenna structure shown in FIG. 1.

FIG. 3 illustrates a voltage standing wave ratio ("VSWR") measurement of the antenna structure 30 shown in FIG. 1. It can be derived from FIG. 3 that the VSWR of the antenna structure 30 is lower than 5 when the antenna structure 30 can operate at frequency bands from about 791 MHz to about 960 MHz and from about 1710 MHz to about 2700 MHz.

Figure 4:
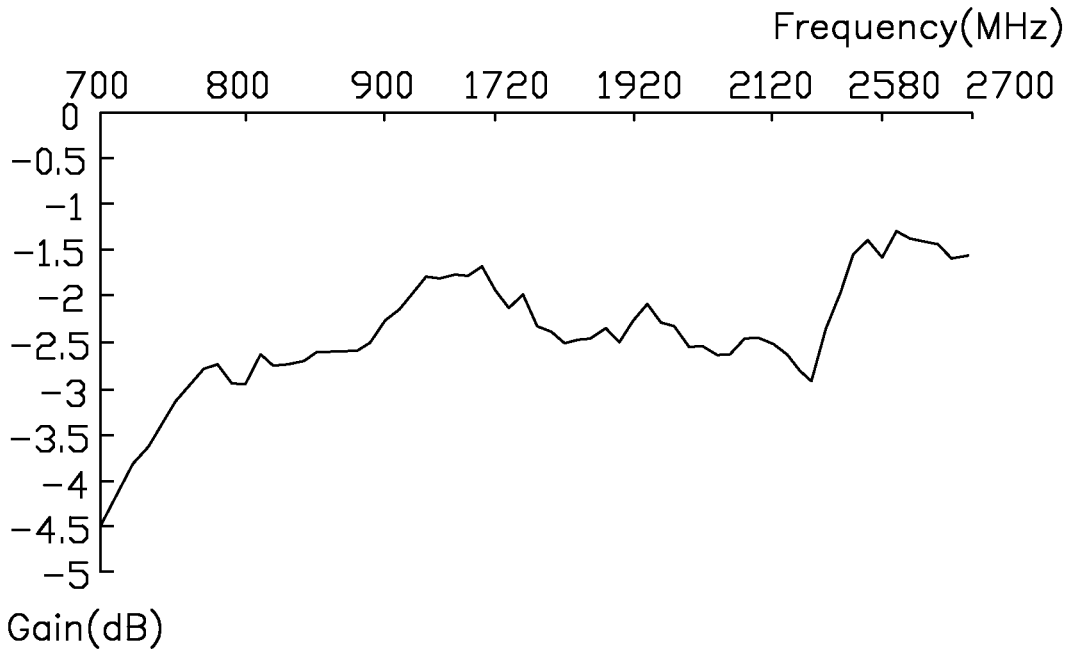
FIG. 4 is a gain measurement of the antenna structure shown in FIG. 1.

FIG. 4 is a gain measurement of the antenna structure 30 shown in FIG. 1. As illustrated in FIG. 4, the gain of the antenna structure 30 is lower than −4.5 dB when the antenna structure 30 can operate at frequency bands from about 791 MHz to about 960 MHz and from about 1710 MHz to about 2700 MHz. Therefore, a low VSWR high efficiency antenna is achieved.

The embodiments shown and described above are only examples. Many details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

a feeding portion configured to feed current signals;

a first grounding portion positioned adjacent to a first side of the feeding portion;

a second grounding portion positioned adjacent to a second side of the feeding portion opposite the first grounding portion;

a first radiating portion coupled to the feeding portion;

a second radiating portion coupled to the first radiating portion;

a third radiating portion coupled to the second radiating portion; and a fourth radiating portion coupled to the second radiating portion;

wherein the first, second and third radiating portions cooperatively form a first current path to excite a low-frequency resonate mode and a first high-frequency resonate mode; the first radiating portion resonates with the first grounding portion to excite a second high-frequency resonate mode; the second, third and fourth radiating portion cooperatively form a second current path to excite a third high-frequency resonate mode;

wherein the feeding portion comprises a first section, a second section, a third section, and a fourth section all of which are coupled sequentially; the first section defines a substantially rectangular cutout at one side thereof facing the second grounding portion; a first end of the second section connecting to the first section is wider than a second end of the second section connecting to the third section; the third section is substantially perpendicular to both the second section and the fourth section; the fourth section is substantially parallel to the second section;

wherein the first grounding portion comprises a first strip and a second strip, the first strip is a substantially rectangular sheet, and is substantially parallel to the first section of the feeding portion, the second strip substantially perpendicularly extends from an end of the first strip along a direction away from the first section of the feeding portion;

wherein the first radiating portion comprises a first arm, a second arm, a third arm, and a fourth arm; the first arm is coupled to an end of the fourth section of the feeding portion, and is wider than the fourth section; the second arm substantially perpendicularly extends from the first arm; the third arm and fourth arm substantially perpendicularly extend from two opposite sides of the second arm respectively, the third arm is wider than the fourth arm;

wherein the second radiation portion is substantially L-shaped, one end of the second radiation portion is coupled to an end of the first arm of the first radiating portion and parallel to the fourth section of the feeding portion, another end of the second radiation portion is coupled to both the third radiating portion and the fourth radiating portion;

wherein the third radiating portion and fourth radiating portion extends toward two opposite directions from the second radiating portion respectively;

wherein the third radiating portion comprises a fifth arm and a sixth arm; the fifth arm substantially perpendicularly extends from the second radiating portion facing the second arm of the first radiating portion; the sixth arm is substantially L-shaped and adjacent to the third arm of the first radiating portion, one end of the sixth arm is substantially perpendicularly coupled to the fifth arm;

wherein the fourth radiating portion comprises a seventh arm and an eighth arm, the seventh arm continuously extends from the fifth arm of the third radiating portion; the eighth arm is substantially L-shaped, and is substantially perpendicularly coupled to the seventh arm; a distal end of the eight arm faces a distal end of the sixth arm.

2. The antenna structure of claim 1, wherein all of the feeding portion, the first grounding portion, the second grounding portion, the first, second, third, and fourth radiating portions are positioned in a same plane; the first, second, third and fourth radiating portions are positioned at the first side of the feeding portion opposite the second grounding portion.

3. A wireless communication device comprising:

a dielectric substrate;

an antenna structure positioned on the dielectric substrate, the antenna structure comprising:

a feeding portion configured to feed current signals;

a first grounding portion positioned adjacent to a first side of the feeding portion;

a second grounding portion positioned adjacent to a second side of the feeding portion opposite the first grounding portion;

a first radiating portion coupled to the feeding portion;

a second radiating portion coupled to the first radiating portion;

a third radiating portion coupled to the second radiating portion; and a fourth radiating portion coupled to the second radiating portion;

wherein the first, second and third radiating portions cooperatively form a first current path to excite a low-frequency resonate mode and a first high-frequency resonate mode; the first radiating portion resonates with the first grounding portion to excite a second high-frequency resonate mode; the second, third and fourth radiating portion cooperatively form a second current path to excite a third high-frequency resonate mode;

wherein the feeding portion comprises a first section, a second section, a third section, and a fourth section all of which are coupled sequentially; the first section defines a substantially rectangular cutout at one side thereof facing the second grounding portion; a first end of the second section connecting to the first section is wider than a second end of the second section connecting to the third section; the third section is substantially perpendicular to both the second section and the fourth section; the fourth section is substantially parallel to the second section;

wherein the first grounding portion comprises a first strip and a second strip, the first strip is a substantially rectangular sheet, and is substantially parallel to the first section of the feeding portion, the second strip substantially perpendicularly extends from an end of the first strip along a direction away from the first section of the feeding portion;

wherein the first radiating portion comprises a first arm, a second arm, a third arm, and a fourth arm; the first arm is coupled to an end of the fourth section of the feeding portion, and is wider than the fourth section; the second arm substantially perpendicularly extends from the first arm; the third arm and fourth arm substantially perpendicularly extend from two opposite sides of the second arm respectively, the third arm is wider than the fourth arm;

wherein the second radiation portion is substantially L-shaped, one end of the second radiation portion is coupled to an end of the first arm of the first radiating portion and parallel to the fourth section of the feeding portion, another end of the second radiation portion is coupled to both the third radiating portion and the fourth radiating portion;

wherein the third radiating portion and fourth radiating portion extends toward two opposite directions from the second radiating portion respectively;

wherein the third radiating portion comprises a fifth arm and a sixth arm; the fifth arm substantially perpendicularly extends from the second radiating portion facing the second arm of the first radiating portion; the sixth arm is substantially L-shaped and adjacent to the third arm of the first radiating portion, one end of the sixth arm is substantially perpendicularly coupled to the fifth arm;

wherein the fourth radiating portion comprises a seventh arm and an eighth arm, the seventh arm continuously extends from the fifth arm of the third radiating portion; the eighth arm is substantially L-shaped, and is substantially perpendicularly coupled to the seventh arm; a distal end of the eight arm faces a distal end of the sixth arm.

4. The wireless communication device of claim 3, wherein the dielectric substrate comprises a first surface and an opposite second surface, the antenna structure is positioned on the first surface; the first, second, third and fourth radiating portions are positioned at the first side of the feeding portion.

5. An antenna structure comprising:

a feeding portion configured to feed current signals;

a first grounding portion positioned adjacent to a first side of the feeding portion;

a second grounding portion positioned adjacent to a second side of the feeding portion and opposite the first grounding portion;

a first current path comprising a first radiating portion coupled to the feeding portion, a second radiating portion coupled to the first radiating portion and, a third radiating portion coupled to the second radiating portion; and a second current path comprising the second radiating portion, the third radiating and a fourth radiating portion coupled to the second radiating portion;

wherein the feeding portion comprises a first section, a second section, a third section, and a fourth section all of which are coupled sequentially; the first section defines a substantially rectangular cutout at one side thereof facing the second grounding portion; a first end of the second section connecting to the first section is wider than a second end of the second section connecting to the third section; the third section is substantially perpendicular to both the second section and the fourth section; the fourth section is substantially parallel to the second section;

wherein the first grounding portion comprises a first strip and a second strip, the first strip is a substantially rectangular sheet, and is substantially parallel to the first section of the feeding portion, the second strip substantially perpendicularly extends from an end of the first strip along a direction away from the first section of the feeding portion;

wherein the first radiating portion comprises a first arm, a second arm, a third arm, and a fourth arm, the first arm is coupled to an end of the fourth section of the feeding portion, and is wider than the fourth section; the second arm substantially perpendicularly extends from the first arm, the third arm and fourth arm substantially perpendicularly extend from two opposite sides of the second arm respectively, the third arm is wider than the fourth arm;

wherein the second radiation portion is substantially L-shaped, one end of the second radiation portion is coupled to an end of the first arm of the first radiating portion and parallel to the fourth section of the feeding portion, another end of the second radiation portion is coupled to both the third radiating portion and the fourth radiating portion;

wherein the third radiating portion and fourth radiating portion extends toward two opposite directions from the second radiating portion respectively;

wherein the third radiating portion comprises a fifth arm and a sixth arm, the fifth arm substantially perpendicularly extends from the second radiating portion facing the second arm of the first radiating portion; the sixth arm is substantially L-shaped and adjacent to the third arm of the first radiating portion, one end of the sixth arm is substantially perpendicularly coupled to the fifth arm;

wherein the fourth radiating portion comprises a seventh arm and an eighth arm, the seventh arm continuously extends from the fifth arm of the third radiating portion; the eighth arm is substantially L-shaped, and is substantially perpendicularly coupled to the seventh arm, a distal end of the eight arm faces a distal end of the sixth arm.

6. The antenna structure of claim 5, wherein all of the feeding portion, the first grounding portion, the second grounding portion, the first, second, third, and fourth radiating portions are positioned in a same plane; the first, second, third and fourth radiating portions are positioned at the first side of the feeding portion.

* * * * *